US007315708B2

(12) United States Patent
Burchette et al.

(10) Patent No.: US 7,315,708 B2
(45) Date of Patent: Jan. 1, 2008

(54) SYSTEMS AND METHODS FOR REMANUFACTURING IMAGING COMPONENTS

(75) Inventors: Lynton R. Burchette, Sanford, NC (US); William Eli Thacker, III, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 228 days.

(21) Appl. No.: 11/143,322

(22) Filed: Jun. 2, 2005

(65) Prior Publication Data

US 2005/0271415 A1 Dec. 8, 2005

Related U.S. Application Data

(63) Continuation-in-part of application No. 10/861,825, filed on Jun. 4, 2004, now abandoned.

(51) Int. Cl.
*G03G 15/00* (2006.01)

(52) U.S. Cl. ..... 399/109

(58) Field of Classification Search ..... 399/8, 399/12, 24–27, 109, 111
See application file for complete search history.

(56) References Cited

U.S. PATENT DOCUMENTS 6,173,128 B1 * 1/2001 Saber et al. ..... 399/24
6,351,621 B1 * 2/2002 Richards et al. ..... 399/12
6,532,351 B2 * 3/2003 Richards et al. ..... 399/111
6,808,255 B1 * 10/2004 Haines et al. ..... 399/12
6,842,709 B2 1/2005 Borg
6,863,364 B2 3/2005 Russell et al.

FOREIGN PATENT DOCUMENTS

| | | |
|---|---|---|
| EP | 0913737 | 5/1999 |
| JP | 05210304 | 8/1993 |
| JP | 11003194 | 1/1999 |
| JP | 2000019803 | 1/2000 |
| JP | 2004054241 | 2/2004 |

* cited by examiner

*Primary Examiner*—William J. Royer

(57) ABSTRACT

Techniques for remanufacturing an imaging cartridge include providing the imaging cartridge including a memory element storing cartridge usage data, reading from the memory element the cartridge usage data, analyzing the cartridge usage data to produce results, and determining, based on the results, if a component of the imaging cartridge needs to be replaced. A cartridge memory interface device includes processing circuitry adapted for reading cartridge usage data from the memory element of the imaging cartridge. The processing circuitry is further adapted for analyzing the cartridge usage data to produce results for determining if any components of the imaging cartridge need to be replaced. A user interface displays the results to a user.

28 Claims, 4 Drawing Sheets

SYSTEMS AND METHODS FOR REMANUFACTURING IMAGING COMPONENTS

This application is a continuation-in-part of application Ser. No. 10/861,825 titled "Systems and Methods for Remanufacturing Imaging Components" filed on Jun. 4, 2004 now abandoned which is incorporated by reference herein in its entirety.

BACKGROUND

The present invention generally relates to remanufacturing and repairing replaceable imaging components, and more particularly to techniques for remanufacturing a replaceable imaging cartridge such as a toner cartridge or inkjet cartridge including a memory element.

In the imaging industry, there is a growing market for the remanufacture and refurbishing of various types of replaceable imaging components such as toner cartridges, ink cartridges, and the like. Toner cartridges, once spent, are unusable for their originally intended purpose. Without a refurbishing process, they would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the cartridge.

Some toner cartridges may include a chip having a memory device which is used to store data related to the cartridge or the imaging device, such as a printer, for example. The printer reads this data to determine certain printing parameters and communicate information to the user. For example, the memory may store the model number of the cartridge so that the printer may recognize the cartridge as one which is compatible with that particular printer. Additionally, by way of example, the cartridge memory may store the number of pages that can be expected to be printed from the cartridge during a life cycle of the cartridge and other useful data. The printer may also write certain data to the memory device, such as the amount of toner remaining in the cartridge. Other data stored in the cartridge may relate to the usage history of the toner cartridge. Thus, it would be advantageous to provide systems and methods for reading and analyzing the data stored in the cartridge memory to assist in the process of remanufacturing the toner cartridge.

SUMMARY

In accordance with an embodiment of the present invention, techniques are provided for reading and analyzing data stored in the memory element of a replaceable imaging component.

In one aspect of the present invention a method of remanufacturing an imaging cartridge includes providing the imaging cartridge including a memory element storing cartridge usage data, reading from the memory element the cartridge usage data, analyzing the cartridge usage data to produce results, and determining, based on the results, if a component of the imaging cartridge needs to be replaced.

In another aspect of the present invention, a cartridge memory interface device includes processing circuitry adapted for reading cartridge usage data from a memory element of an imaging cartridge. The processing circuitry is further adapted for analyzing the cartridge usage data to produce results for determining if any components of the imaging cartridge need to be replaced. A user interface displays the results to a user.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. In the discussion that follows, specific systems and techniques for repairing or remanufacturing a toner cartridge including a memory element are disclosed. Other embodiments having different structures and operations for the repair of other types of replaceable imaging components and for various types of imaging devices do not depart from the scope of the present invention.

Figure 1:
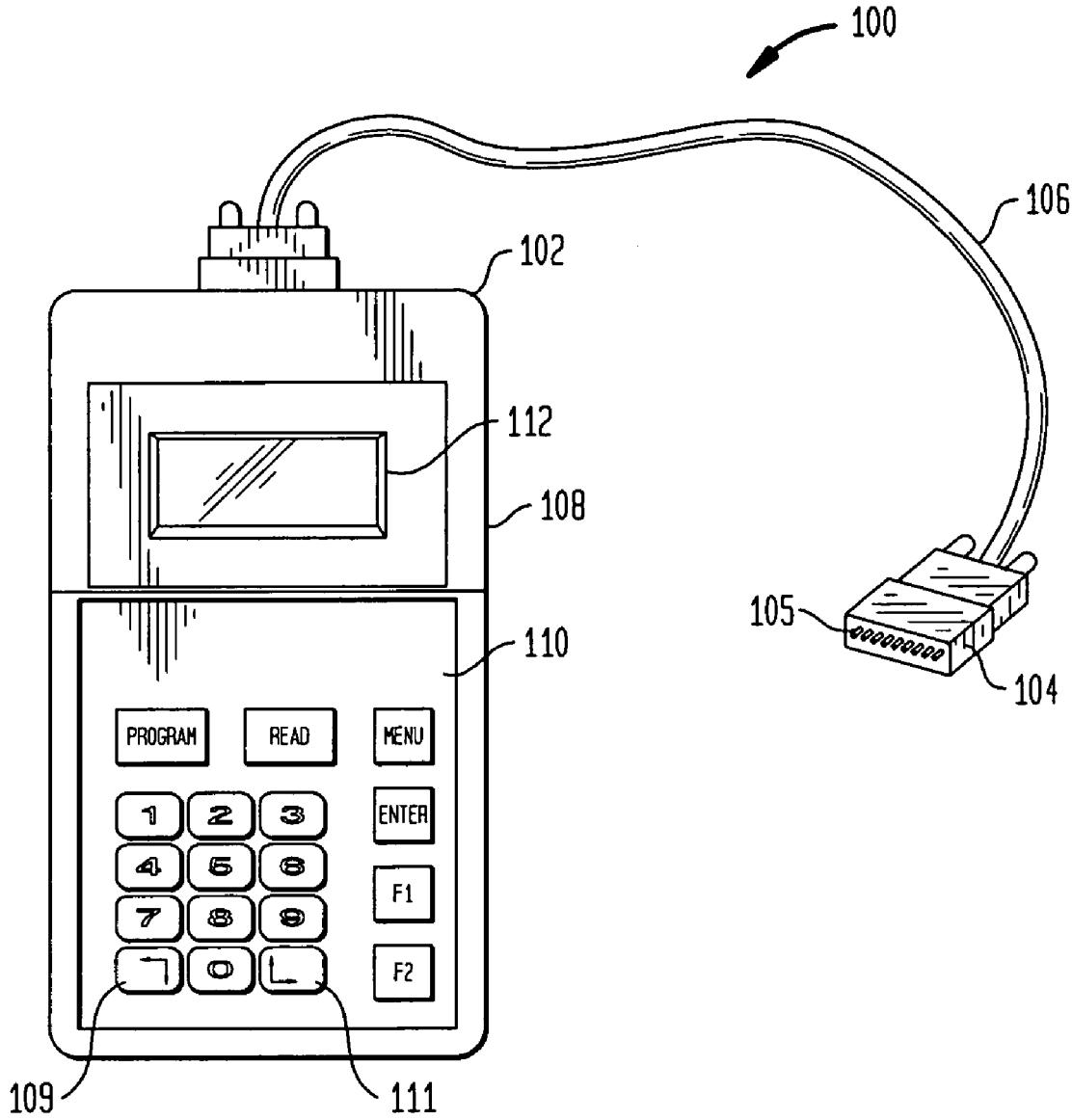
FIG. 1 shows a frontal view of a cartridge memory interface device in accordance with the present invention.

FIG. 1 illustrates a frontal view of a cartridge memory analysis device 100 in accordance with the present invention. The cartridge memory analysis device 100 includes a control unit 102 connected to a pod 104 by a cable 106. A variety of different types of pods 104 may be utilized to interface with different types of cartridge memory elements. The control unit 102 includes a housing 108 enclosing circuitry described in greater detail below. The control unit 102 may be hand-held or adapted to rest on a tabletop. A keypad 110 is utilized by a user to enter data, commands and the like. The keypad 110 may suitably include numeric keys, a program key, a read key, a menu key, an enter key and function keys to allow a user to control the operation of the cartridge memory analysis device 100. A down/left arrow key 109 and an up/right arrow key 111 to move a cursor on a display 112 and navigate through user interface menus displayed on the display 112 are also provided. The display 112 provides feedback and responses to the user, and displays menu options. For cartridge memory elements which communicate directly using one or more contacts or pads, the pod 104 includes one or more contacts 105 and connects to a cartridge memory element in order to transmit data to and receive data from the cartridge memory element of the cartridge through the cable 106. For cartridge memory elements which communicate utilizing radio frequency (RF), the pod 104 having contacts may be replaced with a pod 104 having an RF antenna to allow the cartridge memory analysis device 100 to communicate with such devices. The cartridge memory element, or chip, may be a chip placed on the cartridge by an original equipment manufacturer (OEM) or an aftermarket chip installed on the cartridge by a remanufacturer. While the cartridge memory element typically includes other functionality and circuitry in addition to memory, the term cartridge memory element will be used herein for consistency and is not intended to limit the scope of the present invention.

Figure 2:
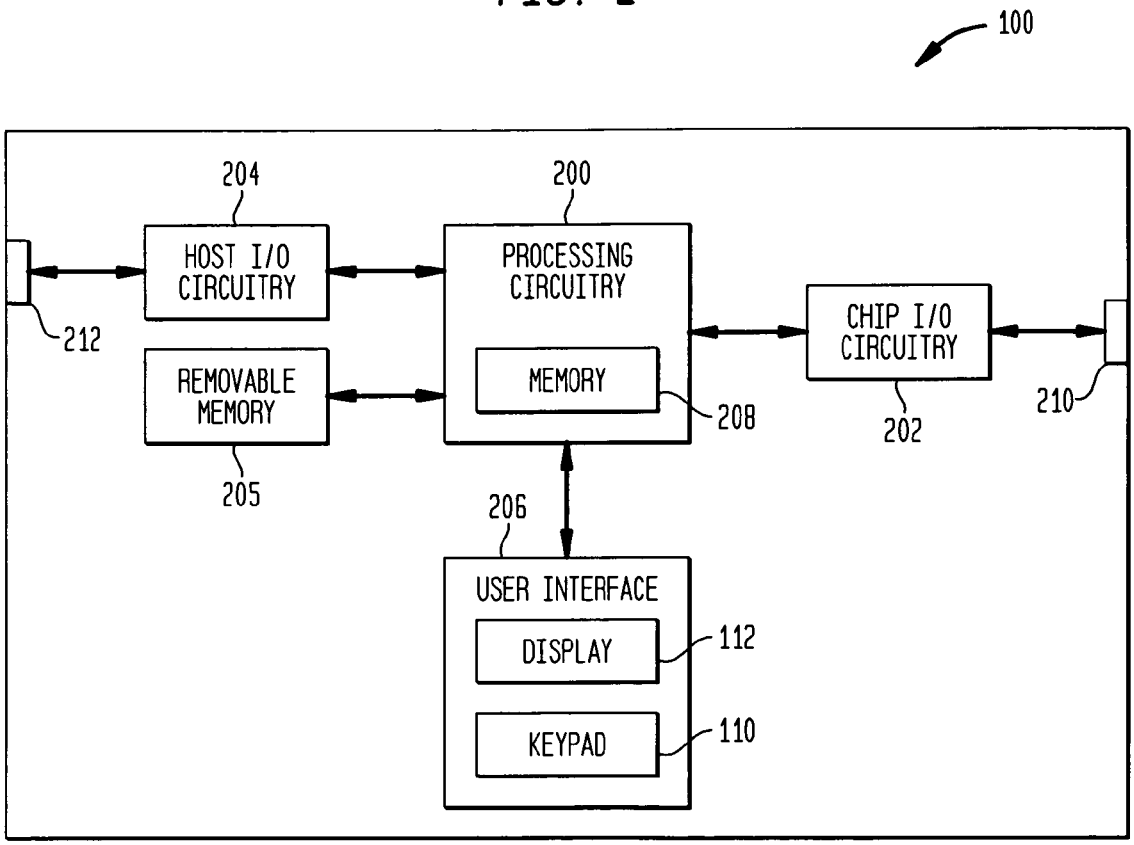
FIG. 2 shows a functional block diagram of a cartridge memory interface device in accordance with the present invention.

FIG. 2 shows a functional block diagram of the cartridge memory analysis device 100 in accordance with the present invention. The cartridge memory analysis device 100 includes processing circuitry 200 communicatively connected to chip input/output (I/O) circuitry 202, host I/O circuitry 204, removable memory 205, and a user interface 206. The user interface 206 preferably comprises the keypad 110 and the display 112, but it will be recognized that data can be entered and provided to a user in a variety of alternative manners. The processing circuitry 200 includes memory 208 which may suitably comprise both volatile memory and nonvolatile memory for storing data and programming code controlling the operation of the cartridge memory analysis device 100. The chip I/O circuitry 202 is communicatively connected to a port 210 and provides the appropriate components and electronic interface to allow the processing circuitry 200 to communicate with the cartridge memory element through the port 210. The host I/O circuitry 204 is communicatively connected to a port 212 and provides the appropriate electronic interface, such as a wired, RF or infrared (IR) interface, for example, to allow the processing circuitry 200 to communicate with an external device through the port 212. Electrical power for the operation of the cartridge memory analysis device 100 may be suitably provided by one or more batteries, a connection to an external DC source and/or a connection to an AC power source.

Figure 3:
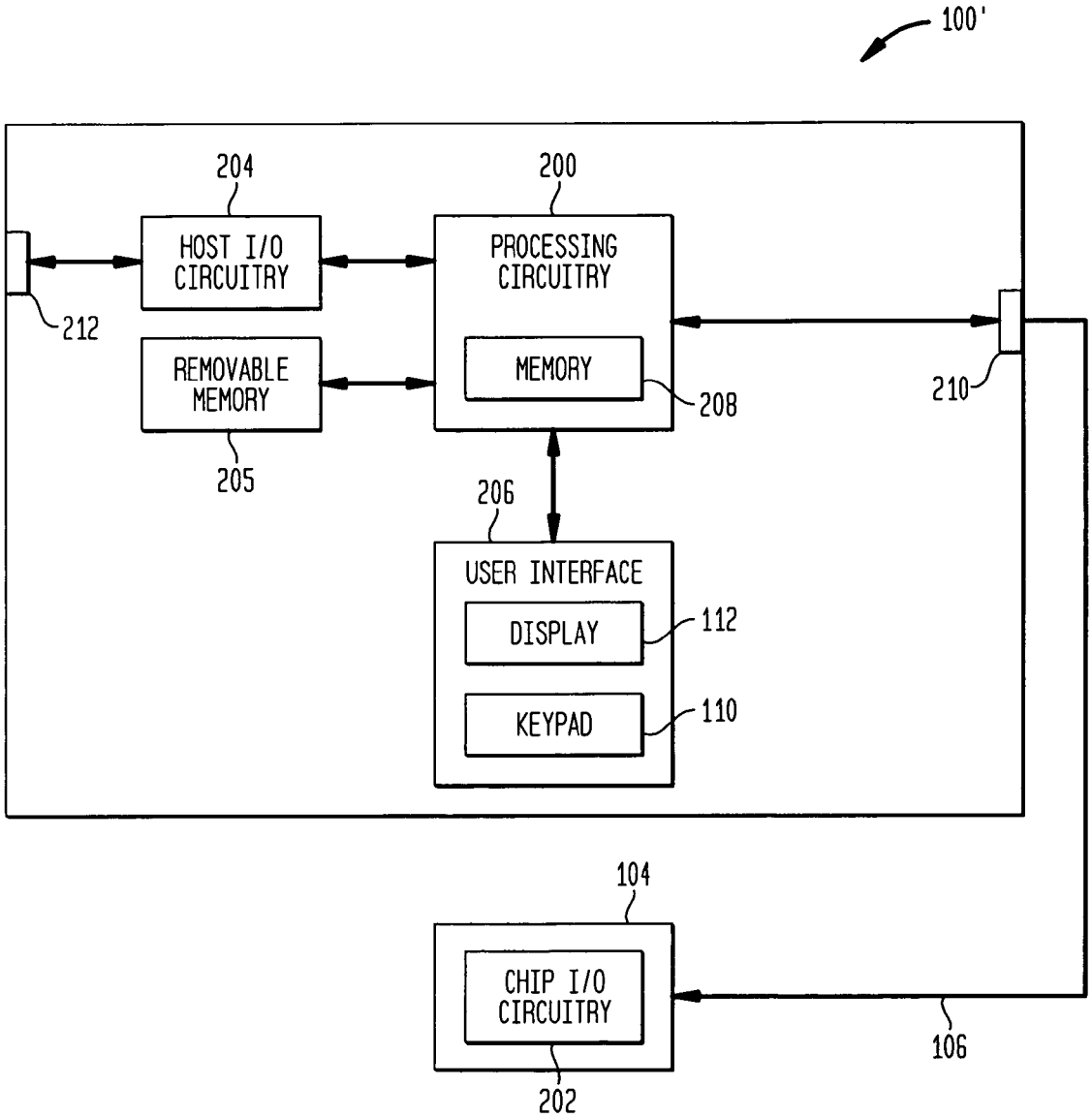
FIG. 3 shows a functional block diagram of an alternate embodiment of a cartridge memory interface device in accordance with the present invention.

In an alternate embodiment, as shown in FIG. 3, the chip I/O circuitry 202 may be disposed in the pod 104. In such a case, the processing circuitry 200 communicates with the chip I/O circuitry 202 through the port 210 and provides power to the cartridge memory element. As would be understood by one skilled in the art, for a direct contact type of pod 104, the chip I/O circuitry 202 may suitably comprise additional processing circuitry, buffers, and an analog interface, for example. For an RF communication type of pod 104, the chip I/O circuitry 202 may suitably comprise additional processing circuitry, buffers, RF interface circuitry and an RF antenna.

The cartridge memory analysis device 100 or 100' may operate in one of three modes. In backup battery powered mode, the device 100 or 100' is in a power managed mode where the display 112 is disabled and battery level monitoring is enabled. In external power standby mode, the display 112 is on, battery level monitoring is enabled, battery charging is enabled and the keypad 110 is waiting for user activity. In external power standby mode, the display 112 is on, battery level monitoring is enabled, battery charging is enabled and the keypad 110 is waiting for user activity.

A cable 106 is attached to the port 210 for communication through the pod 104 with cartridge memory elements having electrical contacts. In an alternate embodiment, an RF antenna may be connected to the port 210 for communicating with the types of memory elements utilizing RF communication. In another alternative embodiment, the port 210 may be configured to allow a cartridge chip to be plugged into the port 210 directly.

The processing circuitry 200 controls the operation of the cartridge memory analysis device 100 or 100' and performs a variety of operations, as described in greater detail below. The processing circuitry 200 may be suitably implemented as a custom or semi-custom integrated circuit, a programmable gate array, a microprocessor executing instructions from memory, a microcontroller, or the like. In a preferred embodiment, the processing circuitry 200 comprises factory-installed firmware which cannot be updated by the user of the cartridge memory analysis device 100 or 100'. The processing circuitry 200 controls the reading of data from and the writing of data to a cartridge memory element. The data read from the cartridge memory element may include a printer type, cartridge serial number, the number of revolutions performed by the organic photoconductor (OPC) drum (drum count), the manufacturing date, number of pages printed (page count), percentage of toner remaining, yield (expected number of pages), color indicator, toner-out indicator, toner low indicator, virgin cartridge indicator (whether or not the cartridge has been remanufactured before), job count (number of pages printed and page type), and any other data that may be stored on the cartridge memory element. The processing circuitry 200 may control multiple user interface menus displayed on the display 112 which allow various functions to be performed on data read from a cartridge memory element.

The cartridge data, once read by the processing circuitry 200 may be displayed on the display 112 for a user. Additionally, the data may be processed or analyzed by the processing circuitry 200 and the results displayed on the display 112 to assist a remanufacturer in refurbishing the toner cartridge. For example, certain components of a toner cartridge, such as the OPC drum, may need to be replaced due to wear, age or other factors when an empty cartridge is refurbished and refilled with toner. Previously, the remanufacturer would typically rely on a visual inspection of the OPC drum to determine whether or not to replace this component. Such a visual inspection system is prone to error and may result in the remanufacturer replacing an OPC drum which does not need replacing and thus wasting money, or not replacing an OPC drum which does need replacing and thus potentially shipping an inferior product to customers.

The cartridge memory analysis device 100 or 100' of the present invention may assist the remanufacturer in making this type of decision by reading cartridge usage data, such as the OPC drum count, from the cartridge memory element and displaying the OPC drum count on the display 112. Processing circuitry 200 may compare that actual OPC drum count with a lifetime expected OPC drum count stored in memory 208. The lifetime expected OPC drum count is the number of revolutions a typical OPC drum for that type cartridge should be expected to complete before failing. The processing circuitry 200 may perform an analysis of the actual OPC drum count and the lifetime expected OPC drum count and display the results of that analysis on the display 112. For example, the results may be a percentage of the OPC drum life remaining, the number of revolutions remaining in the OPC drum life, or the number of pages the OPC drum would be expected to be able to print if it were allowed to remain in the toner cartridge and was not replaced in the remanufacturing process. Other types of analysis may also be performed depending on the type of usage data read from the cartridge memory element, benchmark data stored in memory 208, the needs of the remanufacturer, and the like. For example, pixel count may be used to analyze cartridge usage.

Alternatively, the results may be a recommendation to replace the OPC drum, a recommendation to continue using the OPC drum, or an indication that the results fall into a gray area between the two possible recommendations. In the latter case, the remanufacturer can make the decision as whether to replace the drum based on a variety of business factors, including risk assessment, historical customer usage data and the like. The recommendations may be based on thresholds stored in the memory 208. For example, a low threshold value may indicate that if less than a certain percentage of drum life remains, the drum should be replaced, and a high threshold value may indicate that if at least a certain percentage of drum life remains, the drum should not be replaced. Individual remanufacturers may customize these stored thresholds or other factors affecting the analysis in order to provide results appropriate for their individual environments or markets. In an alternate embodiment, the results may be displayed on the display 112 in graphical form, such as a bar graph, a pie chart or a sequence of colored light emitting diodes (LEDs), for example, indicating the percentage of drum life remaining or the strength of an OPC drum replacement or OPC drum retention recommendation.

In another aspect of the present invention, the remanufacturer may read the cartridge usage data directly from the display 112 and perform the analysis manually or using another processing apparatus, such as a personal computer. For example, the remanufacturer may read the OPC drum count from the display 112 and manually compare that OPC drum count with a lifetime expected OPC drum count. This lifetime expected OPC drum count may be determined or customized by the remanufacturer based on the usage patterns of individual customers. Thus, lifetime expected OPC drum count may vary based on who the actual user of the cartridge is, the manner in which they actually print, or other customer specific data. Based on the analysis of the lifetime expected OPC drum count and the OPC drum count read from the cartridge, the remanufacturer determines if the OPC drum should be replaced or used again during the next cycle of the cartridge. A spreadsheet may be used to store a variety of customer specific data for the plurality of components which may need to be replaced.

Analysis and recommendations for other cartridge components, such as a primary charge roller (PCR), developer roller, and transfer roller, for example, may also be provided. Data on the usage of these components may be read directly from a cartridge memory element, if available. If this data is not stored on the cartridge memory element, the processing circuitry 200 may calculate the usage data based on the OPC drum usage data and the ratio of the diameters of the other rollers to the diameter of the OPC drum, and possibly various gear ratios. For example, if the diameters of the OPC drum and the PCR are known and these elements rotate at a known rate with respect to each other, then the number of revolutions completed by the PCR can be determined based on the number of revolutions completed by the OPC drum. Analysis and recommendations for these other components may be displayed in the same fashion as for the OPC drum.

The removable memory 205 may suitably comprise a smart card, memory stick, or other portable memory or data storage device. Data read from the cartridge memory element and analysis and results of this data may be stored on the removable memory 205 and then transferred to a personal computer or other device for further storage and analysis. Alternatively, the read data and analysis may be transferred to another device through the host I/O circuitry 204 and the port 212.

In a preferred embodiment, the cartridge memory analysis device 100 or 100' is programmed with a predetermined number of read authorizations, or read credits. Each read credit enables the processing circuitry 200 to perform a single read of the data stored on the cartridge memory element. The number of available read credits may be stored in the memory 208 and appropriately decremented by the processing circuitry 200 as reads of cartridge memory elements take place. Read credits may be replenished or added periodically. For example, the manufacturer of the cartridge memory analysis device 100 or 100' may wish to sell read credits to the user of the cartridge memory analysis device 100 or 100'. Alternatively, the manufacturer may wish to give the user the read credits without charge, but may wish to track the number of reads the user is performing by tracking the number of read credits requested by the user.

Some cartridge memory elements must be replaced each time a cartridge is remanufactured, while other cartridge memory elements are can be reset to their initial state, thus advantageously allowing reuse. The cartridge memory analysis device 100 or 100' of the present invention may be used to reset such resettable cartridge memory elements by sending a command to the cartridge memory element which causes the cartridge memory element to return to its initial state or other state suitable to begin operation. In a preferred embodiment, the cartridge memory analysis device 100 or 100' is programmed with a predetermined number of reset authorizations, or reset credits. Each reset credit enables the processing circuitry 200 to perform a single reset of the data stored on the cartridge memory element. The number of available reset credits may be stored in the memory 208 and appropriately decremented by the processing circuitry 200 as resets of cartridge memory elements take place. Reset credits may be replenished or added periodically. For example, the manufacturer of the cartridge memory analysis device 100 or 100' may wish to sell reset credits to the user of the cartridge memory analysis device 100 or 100'.

The read credits and reset credits may be added to the cartridge memory analysis device 100 or 100' by a variety of techniques. The cartridge memory analysis device 110 or 100' may be connected to a host computer which communicates with the processing circuitry 200 to add additional read credits or reset credits to the memory 208. Such communication with an authorized host computer may take place over the Internet and may be encrypted to ensure that read and reset credits are only added with proper authorization. The host computer may also download data from the cartridge memory analysis device 100 or 100' during this communication. For example, this data may include a summary of the types of cartridge memory elements which have been read or reset by the cartridge memory analysis device 100 or 100'. Alternatively, the manufacturer may issue an authorization code for a certain number of read or reset credits to the user which the user enters on the keypad 110. The processing circuitry 200 verifies the authorization code based on a stored algorithm to ensure the validity of the authorization code and adds a number of read or reset credits to the memory 208 as indicated by the authorization code.

Figure 4:
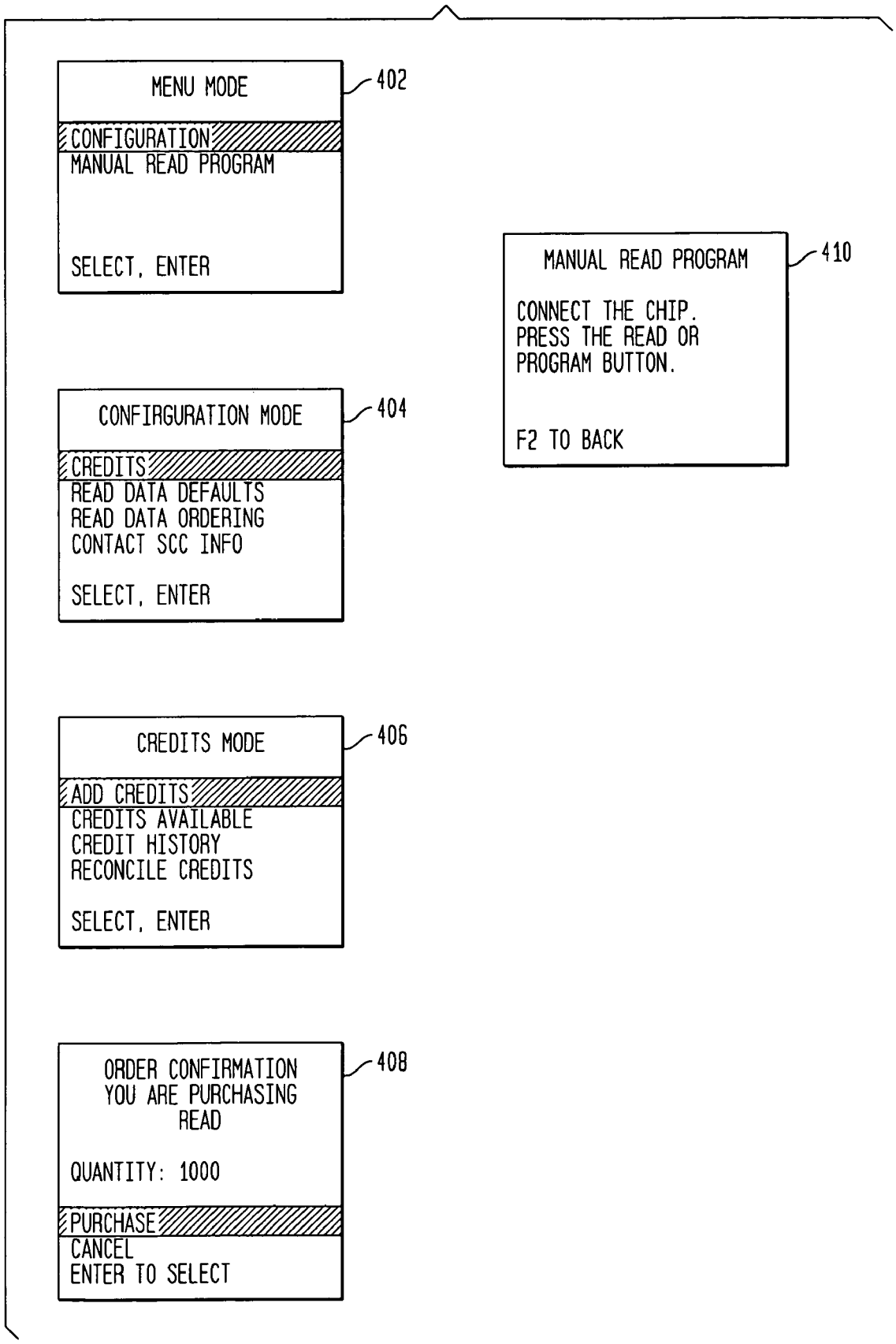
FIG. 4 shows exemplary user interface menus displayed by the cartridge memory interface device in accordance with the present invention.

FIG. 4 shows exemplary user interface menu functions displayed by the display 112 in accordance with the present invention. Display view 402 shows a Menu Mode screen which allows a user to select a Configuration option or a Manual READ Program option. The up/right arrow key 111 and the down/left arrow key 109 may be utilized to move a highlighted cursor to the option desired. The Enter key is then pressed to select the option. When the Configuration option is selected, display view 404 is shown. The Configuration Mode allows a user to select a Credits option, a Read Data Defaults option, a Read Data Ordering option, and a Contact SCC (manufacturer) option. When the Credits option is selected, display view 406 is shown. In addition to other options, the Credits Mode allows the user to select an Add Credits option to add credits (for reading or resetting a cartridge memory element for example) to the device 100 or 100' and a Credits Available option to view available credits currently stored in the device 100 or 100'. After selecting the Add Credits option, the user will scroll up and down a menu of credit types, select the desired cartridge memory element type and enter the number of credits desired. Display view 408 is then shown. The user may then select Purchase and proceed to add credits to the device 100 or 100', as described above. If Manual READ PROGRAM option is selected from Menu Mode, display view 410 is shown. The user then places the pod 104 in the appropriate position to communicate with the cartridge memory element and presses the read key of the keypad 110 to read information from the cartridge memory element or the program key to reset, or program, the cartridge memory element. Confirmation of the successful operation may then be displayed and any information read from the cartridge memory element may be displayed. Additionally, any analysis of the information read from the cartridge memory element may be displayed along with recommendations based on the analysis. Other user interface menus may be suitably utilized.

After remanufacturing a toner cartridge and resetting the cartridge memory element, the remanufacturer may want to test the cartridge by printing a few pages to ensure its proper operation before sending the cartridge to a customer. After such testing, the cartridge memory element needs to be reset again. In one aspect of the present invention, the cartridge memory analysis device 100 or 100' may suitably allow a remanufacturer to perform such a limited test and then allow the remanufacturer to again reset the cartridge memory device without being charged an additional reset credit. For example, when instructed by a user to reset a cartridge memory element, the cartridge memory analysis device 100 or 100' may read the cartridge memory element to determine the number of pages printed since the last reset and if the number of pages printed is less than a certain number, the cartridge memory analysis device 100 or 100' will reset the chip without the remanufacturer being charged or debited for a reset credit.

Certain data stored in the cartridge memory element is read and used by the printer to control toner usage and density. These data may include values which are read by the printer and then used to control the voltage applied to various cartridge components, such as the PCR, for example, which determine the amount of toner applied to an image. The cartridge memory analysis device 100 or 100' of the present invention may advantageously allow individual remanufacturers to control toner usage and density by writing or changing the data stored in the cartridge memory element. Thus, based on their knowledge of the usage patterns of various customers, remanufacturers can customize remanufactured toner cartridges to meet individual customer requirements. This updated or changed data written to the cartridge memory element by the cartridge memory analysis device 100 or 100' may be directly entered by the remanufacturer using the keypad 110, downloaded from a host system through the port 212 or supplied by the manufacturer of the cartridge memory analysis device 100 or 100'.

In one aspect of the present invention, the cartridge memory analysis device 100 or 100' may update the cartridge memory element with new data. For example, new data may be required in order for the cartridge memory element to operate with new firmware updates to the printer. As new data is made available, this data may be transferred to the cartridge memory analysis device 100 or 100' from a host and then transferred to the cartridge memory element when an associated toner cartridge is being remanufactured. As another example, new data may be written to the cartridge memory element to identify the remanufacturer or provide other tracking information.

In another aspect of the present invention, any programming code controlling the operation of the processing circuitry 200 stored in memory 208 may be periodically updated. Updated programming code may be received from a host computer or other suitable device by the cartridge memory analysis device 100 or 100' through host I/O circuitry 204 and the port 212. For example, the host I/O circuitry 204 may be adapted to allow the cartridge memory analysis device 100 or 100' to connect, directly or indirectly, to the Internet, allowing the updated programming code to be downloaded from an Internet connected computer.

In one embodiment of the present invention, communication between the cartridge memory element and the cartridge memory analysis device 100 or 100' is encrypted to prevent unauthorized access to the cartridge memory element. Additionally, communication between the cartridge memory analysis device 100 or 100' and the host computer may also be encrypted.

In another aspect of the present invention, the cartridge memory analysis device 100 or 100' may not store a number of read or reset credits, but may be connected to a host computer through the Internet which directly performs a read or a reset. The cartridge memory analysis device 100 or 100' acts as a conduit of data to and from the cartridge memory element, and does not store the data necessary to reset the cartridge memory element.

Although specific embodiments have been illustrated and described herein, those of ordinary skill in the art will appreciate that any arrangement which is calculated to achieve the same purpose may be substituted for the specific embodiments shown and that the invention has other applications in other environments. This application is intended to cover any adaptations or variations of the present invention. For example, the analysis functions of the present invention may also suitably be performed manually, rather than utilizing processing apparatus. The following claims are in no way intended to limit the scope of the invention to the specific embodiments described herein.

What is claimed is:

1. A method of remanufacturing an imaging cartridge comprising:

providing the imaging cartridge including a memory element storing cartridge usage data;

reading from the memory element the cartridge usage data;

analyzing the cartridge usage data to produce results;

determining, based on the results, if a component of the imaging cartridge needs to be replaced;

displaying the results on a display of an analysis device; and determining usage data of a second rotatable element of the imaging cartridge utilizing a ratio of a measurement of the rotatable element to a measurement of the second rotatable element, wherein the imaging cartridge comprises a rotatable element and the cartridge usage data includes a number of revolutions completed by the rotatable element, and wherein the step of analyzing further comprises comparing the number of revolutions completed by the rotatable element with a reference number indicative of an expected number of revolutions which can be completed during the useful life of the rotatable element.

2. The method of claim 1 further comprising:

determining, based on the usage data of the second rotatable element, if the second rotatable element of the imaging cartridge needs to be replaced.

3. A method of remanufacturing an imaging cartridge comprising:

providing the imaging cartridge including a memory element storing cartridge usage data;

reading from the memory element the cartridge usage data;

analyzing the cartridge usage data to produce results; and determining, based on the results, if a component of the imaging cartridge needs to be replaced, wherein the step of analyzing is performed by processing circuitry of an analysis device, said processing circuitry at least partially controlled by programming code stored in memory of the analysis device, and wherein the memory stores a number of read credits, each read credit allowing the analysis device to perform a read of the memory element.

4. The method of claim 3 further comprising, after the step of reading:

decrementing the number of read credits.

5. The method of claim 3 further comprising:

receiving an authorization message authorizing an additional number of credits; and incrementing the stored number of credits by the additional number of credits authorized.

6. The method of claim 5 wherein the step of receiving comprises:

transmitting the authorization message from a host computer to the analysis device through the Internet.

7. The method of claim 5 wherein the step of receiving comprises:

inputting the authorization message on a keypad of the analysis device.

8. A cartridge memory interface device comprising:

processing circuitry adapted for reading cartridge usage data from a memory element of an imaging cartridge, said processing circuitry further adapted for analyzing the cartridge usage data to produce results for determining if a component of the imaging cartridge needs to be replaced; and a user interface for displaying the results to a user, wherein the imaging cartridge comprises a rotatable element and the cartridge usage data includes a number of revolutions completed by the rotatable element, wherein the processing circuitry is adapted for comparing the number of revolutions completed by the rotatable element with a reference number indicative of an expected number of revolutions which can be completed during the useful life of the rotatable element, wherein the user interface displays the results to the user in graphical form, and wherein the processing circuitry is adapted for determining usage data of a second rotatable element of the imaging cartridge utilizing a ratio of a measurement of the rotatable element to a measurement of the second rotatable element.

9. The cartridge memory interface device of claim 8 wherein the processing circuitry is adapted for determining, based on the usage data of the second rotatable element, if the second rotatable element of the imaging cartridge needs to be replaced.

10. A cartridge memory interface device comprising:

processing circuitry adapted for reading cartridge usage data from a memory element of an imaging cartridge, said processing circuitry further adapted for analyzing the cartridge usage data to produce results for determining if a component of the imaging cartridge needs to be replaced; and a user interface for displaying the results to a user, wherein the processing circuitry comprises a memory storing a count of read credits.

11. The cartridge memory interface device of claim 10 wherein each read credit allows the cartridge memory interface device to perform a read of the memory element of the imaging cartridge.

12. The cartridge memory interface device of claim 11 wherein the processing circuitry decrements the count of read credits after each read of the memory element of the imaging cartridge.

13. The cartridge memory interface device of claim 11 wherein the processing circuitry is adapted to increment the count of read credits if proper authorization is received.

14. The cartridge memory interface device of claim 13 further comprising host interface circuitry communicatively connected to the processing circuitry, the processing circuitry adapted for receiving the authorization through the host interface circuitry from a host computer connected to the Internet.

15. The cartridge memory interface device of claim 13 further comprising a keypad communicatively connected to the processing circuitry, the processing circuitry adapted for receiving the authorization entered on the keypad.

16. A cartridge memory interface device comprising:

processing circuitry adapted for reading cartridge usage data from a memory element of an imaging cartridge, said processing circuitry further adapted for analyzing the cartridge usage data to produce results for determining if a component of the imaging cartridge needs to be replaced; and a user interface for displaying the results to a user, wherein the processing circuitry comprises a memory storing a count of reset credits.

17. The cartridge memory interface device of claim 16 wherein each reset credit allows the cartridge memory interface device to perform a reset of the memory element of the imaging cartridge.

18. The cartridge memory interface device of claim 17 wherein the processing circuitry decrements the count of reset credits after each reset of the memory element of the imaging cartridge.

19. The cartridge memory interface device of claim 17 wherein the processing circuitry is adapted to increment the count of reset credits if proper authorization is received.

20. The cartridge memory interface device of claim 19 further comprising host interface circuitry communicatively connected to the processing circuitry, the processing circuitry adapted for receiving the authorization through the host interface circuitry from a host computer connected to the Internet.

21. The cartridge memory interface device of claim 19 further comprising a keypad communicatively connected to the processing circuitry, the processing circuitry adapted for receiving the authorization entered on the keypad.

22. A method of analyzing an imaging cartridge including a memory element storing cartridge usage data, the method comprising:

reading from the memory element the cartridge usage data; and analyzing the cartridge usage data to determine if a component of the imaging cartridge is suitable for reuse, wherein the imaging cartridge comprises a rotatable element and the cartridge usage data includes a number of revolutions completed by the rotatable element, the method further comprising:

determining usage data of a second rotatable element of the imaging cartridge utilizing a ratio of a measurement of the rotatable element to a measurement of the second rotatable element.

23. The method of claim 22 further comprising:

determining, based on the usage data of the second rotatable element, if the second rotatable element of the imaging cartridge is suitable for reuse.

24. A method of analyzing an imaging cartridge including a memory element storing cartridge usage data, the method comprising:

reading from the memory element the cartridge usage data; and analyzing the cartridge usage data to determine if a component of the imaging cartridge is suitable for reuse, wherein the step of analyzing is performed by processing circuitry of an analysis device, said processing circuitry at least partially controlled by programming code stored in memory of the analysis device, and wherein the memory stores a number of read credits, each read credit allowing the analysis device to perform a read of the memory element.

25. The method of claim 24 further comprising, after the step of reading:

decrementing the number of read credits.

26. The method of claim 24 further comprising:

receiving an authorization message authorizing an additional number of credits; and incrementing the stored number of credits by the additional number of credits authorized.

27. The method of claim 26 wherein the step of receiving comprises:

transmitting the authorization message from a host computer to the analysis device through the Internet.

28. The method of claim 26 wherein the step of receiving comprises:

inputting the authorization message on a keypad of the analysis device.

* * * * *